US008910709B2

(12) United States Patent
Thomson et al.

(10) Patent No.: US 8,910,709 B2
(45) Date of Patent: Dec. 16, 2014

(54) EXPANDABLE LINER TIEBACK CONNECTION

(75) Inventors: Neil Thomson, Aberdeen (GB); Peter Wood, Aberdeen (GB); Andrew Gorrara, Stonehaven (GB)

(73) Assignee: Meta Downhole Limited, Aberdeen (GB)

( * ) Notice: Subject to any disclaimer, the term of this patent is extended or adjusted under 35 U.S.C. 154(b) by 302 days.

(21) Appl. No.: 13/501,249

(22) PCT Filed: Oct. 22, 2010

(86) PCT No.: PCT/GB2010/051779

§ 371 (c)(1),
(2), (4) Date: May 22, 2012

(87) PCT Pub. No.: WO2011/048426

PCT Pub. Date: Apr. 28, 2011

(65) Prior Publication Data

US 2012/0227984 A1 Sep. 13, 2012

(30) Foreign Application Priority Data

Oct. 23, 2009 (GB) ..... 0918627.1

(51) Int. Cl.
*E21B 23/04* (2006.01)
*E21B 43/10* (2006.01)

(52) U.S. Cl.
CPC ..... *E21B 43/108* (2013.01)
USPC ..... 166/207; 166/208; 166/384

(58) Field of Classification Search
CPC ..... E21B 19/16; E21B 23/00
USPC ..... 166/384, 206, 207, 208, 216, 217
See application file for complete search history.

(56) References Cited

U.S. PATENT DOCUMENTS

| | | | | |
|---|---|---|---|---|
| 5,095,991 | A * | 3/1992 | Milberger | 166/380 |
| 5,335,729 | A * | 8/1994 | Turner et al. | 166/380 |
| 7,017,670 | B2 * | 3/2006 | Hazel et al. | 166/382 |
| 7,195,073 | B2 * | 3/2007 | Fraser, III | 166/380 |
| 7,367,391 | B1 * | 5/2008 | Stuart et al. | 166/208 |
| 7,422,068 | B2 * | 9/2008 | Lynde | 166/380 |
| 2007/0158081 | A1 | 7/2007 | Harrall et al. | |

FOREIGN PATENT DOCUMENTS

| | | | |
|---|---|---|---|
| GB | 2345308 | A | 7/2000 |
| WO | WO-2004/099562 | A1 | 11/2004 |

OTHER PUBLICATIONS

Strømmen, Henrik, "International Search Report" for PCT/GB2010/051779 as mailed Jun. 20, 2011, 3 pages.

* cited by examiner

*Primary Examiner* — Kenneth L Thompson
(74) *Attorney, Agent, or Firm* — Law Office of Jesse D. Lambert, LLC

(57) ABSTRACT

A method of connecting a first tubular member to a second tubular member located in a wellbore, the second tubular member including an upper end portion which has a greater diameter than the diameter of the first tubular member, the method comprising: lowering the first tubular member into the wellbore until the first tubular member is located at least within the bore of the upper end portion of the second tubular member; and expanding the first tubular member until the first tubular member is sealingly connected to the second tubular member.

10 Claims, 2 Drawing Sheets

EXPANDABLE LINER TIEBACK CONNECTION

BACKGROUND OF THE INVENTION

1. Field of the Invention

The present invention relates to apparatus and methods of connecting tubular members in a wellbore.

2. Description of the Related Art

Oil and gas wells are completed by forming a borehole in the earth and then lining the borehole with a steel casing to form a wellbore. Typically, a number of sections of casing are used. A first section of casing is lowered into the wellbore and hung from the surface after the well has been drilled to a first designated depth. Cement is then circulated in the annulus between the outer wall of the casing and the borehole. The well is then drilled to a second designated depth and a second section of casing having a smaller diameter is run into the well. The second section may either be "hung off" in a wellhead at surface or is set at a depth such that the upper portion of the second section overlaps the lower portion of the first section of casing. If, in this second example, the casing does not extend to surface then the casing is referred to as a liner. The liner section is then fixed to the first section, such as by using a liner hanger. The second casing section or liner is then cemented. This process is typically repeated with additional casing sections of decreasing diameter until the well has been drilled to the total required depth.

The area above the production zone of the well is typically sealed using packers inside the casing or liner and connected to the surface via smaller diameter tubing. This provides a redundant barrier to leaks, and allows damaged sections to be replaced. Also, the smaller diameter of the tubing increases the velocity of the oil and gas. The natural pressure of the subsurface reservoir may be high enough for the oil or gas to flow to the surface. When this is not sufficient, such as for older wells, installing smaller diameter tubing may help the production, but artificial lift methods, such as gas lift, may also be needed. The well needs to be configured to receive the artificial lift apparatus.

In another well completion scheme it may be necessary to connect the liner string back to the surface (or a point higher up in the well). A string of tubing is then connected to the top of the liner section. In this manner, the casing section is sealingly "tied back" to the surface (or a point higher in the well).

Known methods for connecting a string of tubing into a downhole liner section typically involve the use of a tool known as a polished bore receptacle (PBR). The PBR is a separate tool which is screwed to the top of the liner section. The PBR has a smoothed cylindrical inner bore configured to receive the lower end of the tieback tubing. The tubing is landed in the PBR to form a sealed connection between the tubing and the liner. The lower portion of the tubing is configured with seals on its outer diameter and these seals seal within the PBR.

However, the majority of the length of the PBR is exposed and is susceptible to damage as other downhole tools are run into the wellbore. A downhole tool being run through the PBR may impact the polished surface of the PBR on its way downhole. This can cause damage that reduces the sealing ability of the PBR. Also, drilling debris can degrade the PBR sealing surfaces. In addition, it is known that associated components, such as tie back stingers and packers can leak, particularly in harsh environments.

The PBR allows for thermal expansion and contraction of the tieback liner, during which the liner seals can move up and down in the PBR. Over time this movement can cause the seals to wear and ultimately to fail. This is regarded to be one of the major limitations of a conventional PBR.

It is desirable to provide an alternative means of connecting to a lower section of liner which eliminates the need for a PBR or which reduces the likelihood of damage to a PBR. It is desirable to provide an alternative means of connecting to a lower section of liner which can eliminate the need for one or more associated components, such as anchors, tie back stingers and packers. It is desirable to provide an alternative means for providing a metal to metal seal between two tubular sections.

It is known to provide tools which cause the expansion of tubular sections in situ to connect the sections and provide a seal. These tools can include radially expandable members which, using fluid pressure, are urged outward radially into contact with a tubular section. When sufficient pressure is generated, the tubular section is expanded as it elastically and then plastically deforms.

There are a number of advantages of this over a conventional PBR. The tubing is anchored with sufficient resistance to the thermally generated axial loads. There is therefore little or no movement and so no wear. Also, this device has a metal to metal seal and so no elastomers to wear out. Also, the internal diameter of the device is not a polished seal surface and so its performance is much less affected by damage. Also, higher burst and collapse loads can be achieved.

BRIEF SUMMARY OF THE INVENTION

According to a first aspect of the present invention there is provided a method of connecting a first tubular member to a second tubular member located in a wellbore, the second tubular member including an upper end portion which has a greater diameter than the diameter of the first tubular member, the method comprising:

lowering the first tubular member into the wellbore until the first tubular member is located at least within the bore of the upper end portion of the second tubular member; and expanding the first tubular member until the first tubular member is sealingly connected to the second tubular member.

The method may include running the first tubular member from the surface to the second tubular member.

The method may include adapting the upper end portion of the second tubular member to receive the first tubular member. The method may include providing a receiving member at the upper end of the second tubular member, the receiving member having a greater diameter than the diameter of the first tubular member.

The receiving member may comprise a tieback profile device. The tieback profile device may include at least one recess provided at an internal bore of the device.

The method may include using a fixing member to fix the upper end of the second tubular member within the wellbore. The fixing member may comprise a liner hanger. The fixing member may be provided at the receiving member.

The method may include using an expandable tool to expand the first tubular member. The method may include running the expandable tool on a drill string through the bore of the first tubular member. The method may include aligning the expandable tool with the or each recess of the tieback profile device. The method may include using a depth latch arrangement to position the expandable tool at the correct vertical depth.

The expandable tool may include a pair of seals which are vertically spaced apart. The seals may be actuatable to form a seal between the outer surface of the tool and the inner surface of the first tubular member to define a chamber between the seals. The expandable tool may be configured to supply a fluid to the chamber to apply pressure on the internal surface of the first tubular member such that the first tubular member expands into the or each recess to form a seal between the second tubular member and the first tubular member.

According to a second aspect of the present invention there is provided an apparatus for carrying out a method according to the first aspect of the present invention.

BRIEF DESCRIPTION OF THE SEVERAL VIEWS OF THE DRAWINGS

Embodiments of the present invention will now be described, by way of example only, with reference to the accompanying drawings in which.

DETAILED DESCRIPTION OF THE INVENTION

Figure 2:
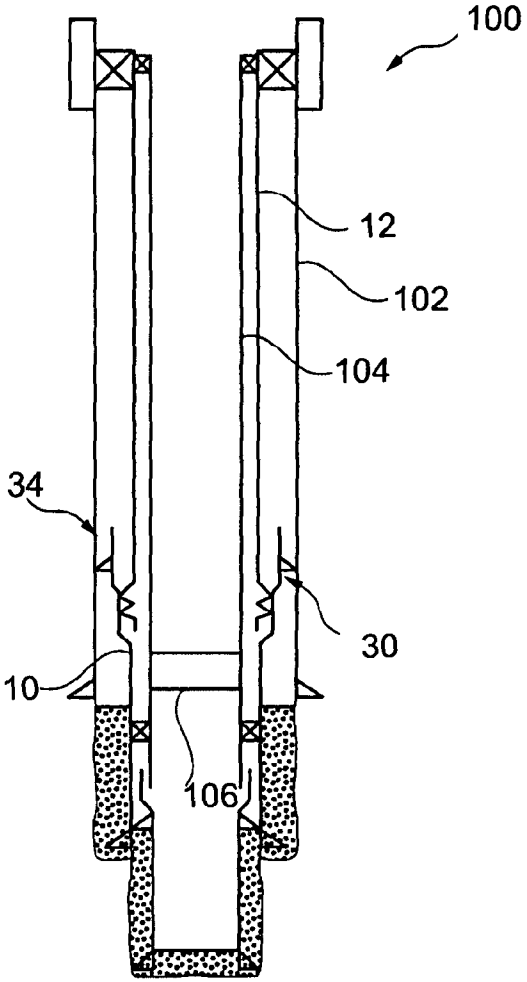
FIG. 2 is a sectional side view of a method of connecting two tubes according to the invention.
Figure 1:
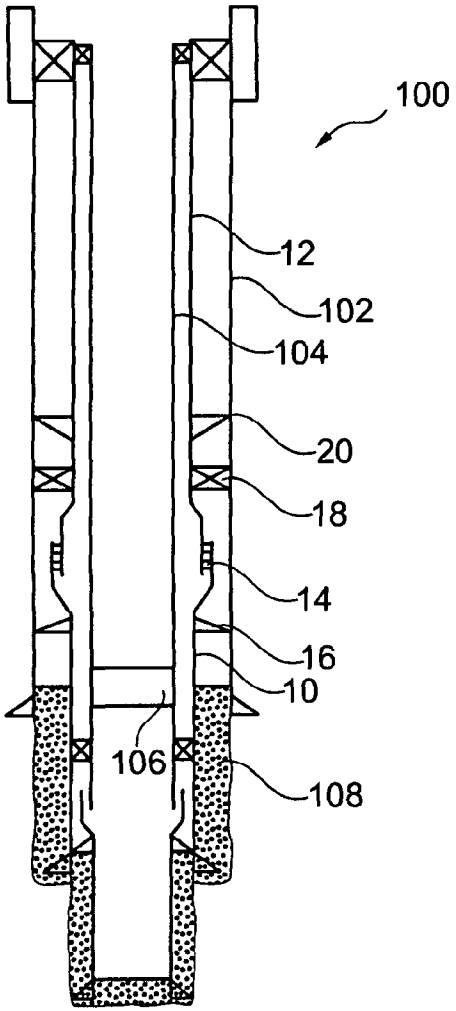
FIG. 1 is a sectional side view of a method of connecting two tubes according to the prior art.

FIG. 1 shows a known method of connecting two tubular members in a wellbore 100 in which a second tube 10 is tied back to the surface using a first tube 12. The wellbore 100 is lined with a casing 102 which incrementally decreases in diameter as the depth increases. Tubing 104 for gas lift, with an internal gas lift valve 106, is provided within the casing 102.

The second tube 10 has a diameter of 9⅝ in (244 mm) and extends upwards into the upper adjacent casing which has a diameter of 13⅜ in (340 mm). A PBR 14 is connected to the upper end of the second tube 10. A liner hanger 16 at an upper portion, and cement 108 at a lower portion, fix the second tube 10 within the wellbore 100.

The first tube 12 is lowered and the lower end of the first tube 12 fits within the polished bore of the PBR 14. By itself, particularly in harsh environments, the PBR 14 may not be able to provide sufficient sealing and so a tie back packer 18 can be provided above the joint of the first and second tubes.

The slidable sealing provided by the PBR 14 does not assist with supporting the first tube 12 in the wellbore 100 and so an anchor 20 may also provided.

FIGS. 2 to 5 show an alternative method according to the invention of connecting two tubular members in a wellbore 100. Like features are given like reference numerals.

A tieback profile device 30 is provided at the upper end of the second tube 10 such that it has a greater diameter than the diameter of the second tube 10. The device 30 includes a number of internal recesses 32 at its internal bore. A 13⅜ in (340 mm) by 11¾ in (298 mm) liner hanger 34 is connected to the top of the device 30 and this attaches to the casing at the inner surface of the wellbore 100. The liner hanger 34, device 30 and upper portion of the second tube 10 are all configured to cross over from 13⅜ in (340 mm) to an outer diameter of 9⅝ in (244 mm).

Figures 3, 4, 5:
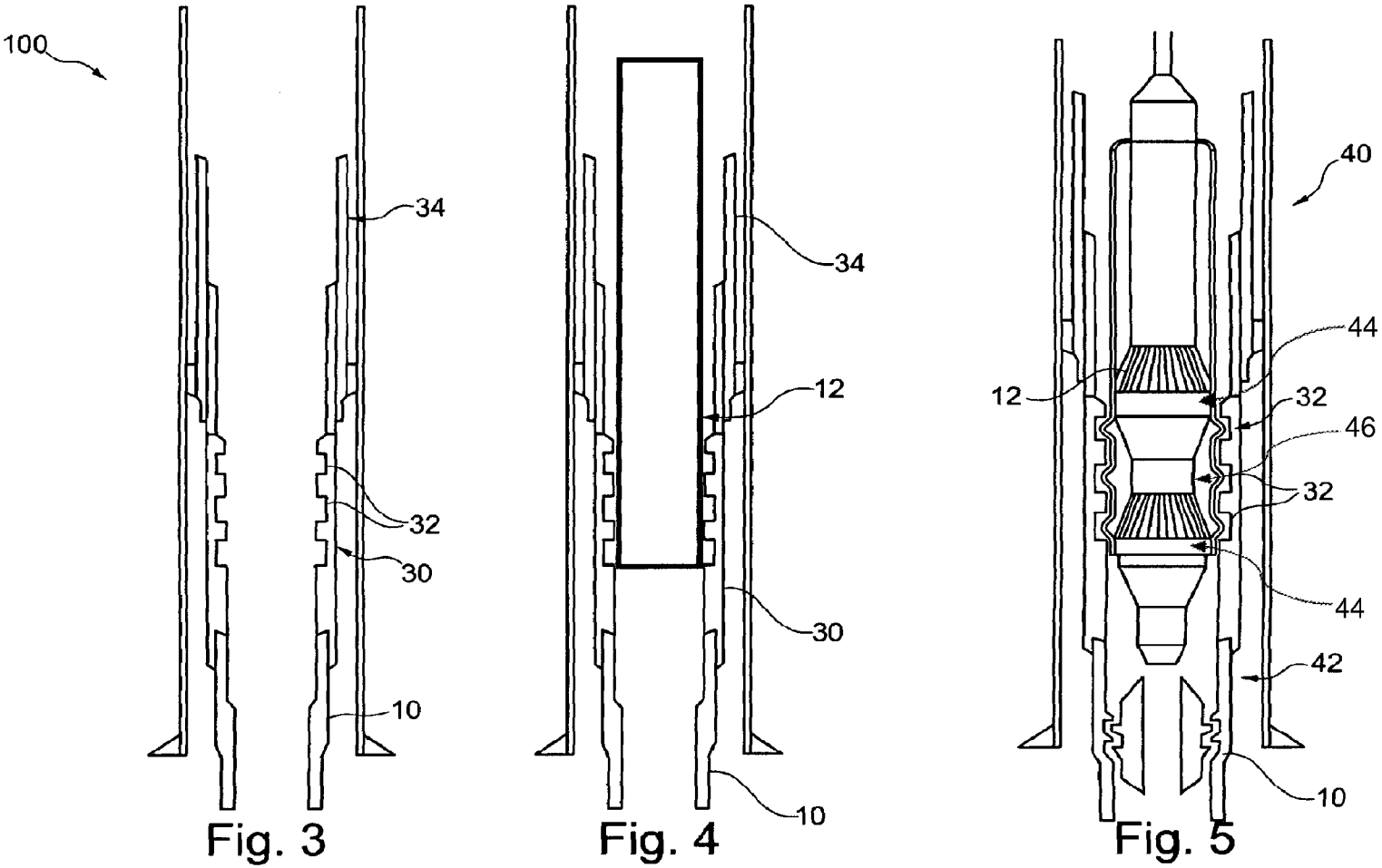
FIGS. 3 to 5 are sectional side views of stages of the method of FIG. 2.

FIGS. 3 to 5 show specific details of the invention to illustrate the sequence for installing the first tube 12. The first tube 12 is lowered so that its lower end is within the device 30 and lower than the internal recesses 32 of the device 30 (FIG. 4).

An expandable tool 40 is then run on the lower end of a string of drillpipe down through the bore of the first tube 12 until the tool 40 is aligned with the recesses 32 of the device 30. The tool 40 includes a depth latch arrangement 42 for positioning at the correct vertical depth. The tool 40 includes a pair of seals 44 which are vertically spaced apart by a distance greater than the vertical distance between the upper and lower recesses.

The seals 44 are actuated to form a seal between the outer surface of the tool 40 and the inner surface of the first tube 12 to define a chamber 46 between the seals 44. Water is pumped through the drillstring, into the bore of the tool 40 and through apertures of the tool 40 and into the chamber. When the water pressure is sufficient, the first tube 12 expands by elastic then plastic deformation into the recesses 32. This creates a mechanical fixing and metal to metal seal between the second tube 10 and the first tube 12 via the device 30. The first tube 12 is now tied back to the surface. The seals 44 can then be de-activated and the drill pipe string and tool 40 removed from the wellbore 100.

The present invention provides strong metal to metal seals which are qualified to a modified ISO13679 specification. The method allows the omission of certain associated components that are required in conventional methods. There are no moving parts in the sealing arrangement. The connection can withstand high burst and collapse pressures and high load capability in both tension and compression.

Whilst specific embodiments of the present invention have been described above, it will be appreciated that departures from the described embodiments may still fall within the scope of the present invention.

We claim:

1. A method of connecting a first tubular member to a second tubular member located in a wellbore, the second tubular member including an upper end portion which has a greater diameter than the diameter of the first tubular member, the method comprising:

providing a receiving member comprising a tieback profile device at the upper end of the second tubular member, the tieback profile device having a greater diameter than the diameter of the first tubular and wherein the tieback profile device includes at least one recess provided at an internal bore of the device;

lowering the first tubular member into the wellbore until the first tubular member is located at least within the bore of the upper end portion of the second tubular member; and expanding the first tubular member until the first tubular member is sealingly connected to the second tubular member by using an expandable tool to expand the first tubular member;

wherein the expandable tool includes a pair of seals which are vertically spaced apart, wherein the seals are actuatable to form a seal between the outer surface of the tool and the inner surface of the first tubular member to define a chamber between the seals wherein the expandable tool is configured to supply a fluid to the chamber to apply pressure on the internal surface of the first tubular member such that the first tubular member expands into the or each recess to form a seal between the second tubular member and the first tubular member.

2. A method as claimed in claim 1, including running the first tubular member from the surface to the second tubular member.

3. A method as claimed in claim 1, including adapting the upper end portion of the second tubular member to receive the first tubular member.

4. A method as claimed in claim 1, including using a fixing member to fix the upper end of the second tubular member within the wellbore.

5. A method as claimed in claim 4, wherein the fixing member comprises a liner hanger.

6. A method as claimed claim 4, wherein the fixing member is provided at the receiving member.

7. A method as claimed in claim 1, including running the expandable tool on a drill string through the bore of the first tubular member.

8. A method as claimed in claim 1, including aligning the expandable tool with the or each recess of the tieback profile device.

9. A method as claimed in claim 1, including using a depth latch arrangement to position the expandable tool at the correct vertical depth.

10. An apparatus for carrying out a method according to claim 1.

* * * * *